US006690620B1

(12) United States Patent
Mapes

(10) Patent No.: US 6,690,620 B1
(45) Date of Patent: Feb. 10, 2004

(54) SONAR TRANSDUCER WITH TUNING PLATE AND TUNING FLUID

(75) Inventor: Theodore J. Mapes, Waitfield, VT (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/244,922

(22) Filed: Sep. 12, 2002

(51) Int. Cl.[7] ..... H04R 1/00
(52) U.S. Cl. ..... 367/152
(58) Field of Search ..... 367/152, 166, 367/171, 188; 310/328, 337

(56) References Cited

U.S. PATENT DOCUMENTS 2,906,993 A * 9/1959 Steinberger ..... 367/152
4,364,117 A * 12/1982 Snow ..... 367/152
4,694,440 A * 9/1987 Ogura et al. ..... 367/152

* cited by examiner

*Primary Examiner*—Daniel T. Pihulic

(74) *Attorney, Agent, or Firm*—James M. Kasischke; Michael F. Oglo; Jean-Paul A. Nasser

(57) ABSTRACT

A method for maximizing the radiated power of a transducer, such as a sonar transducer, includes providing a transducer system comprising a transducer operating at a frequency f and having a radiating face, a tuning fluid having a density $\rho_1$ and a speed of sound $c_1$, a tuning plate having a density $\rho_p$ and a thickness t, and an external fluid having a density $\rho_2$ and a speed of sound $c_2$; and tuning the transducer to have a maximum specific acoustic resistance at the radiating face in accordance with the equation:

$$\left[\frac{(2\pi f \rho_p t)^2}{\rho_2 c_2 \rho_1 c_1} + \frac{\rho_1 c_1}{\rho_2 c_2}\right]\rho_1 c_1.$$

The present invention also relates to changing the resonance frequency of a transducer including providing a transducer system with an operating frequency f, the tuning plate spaced from the transducer face by a distance s, and the tuning fluid between the transducer face and the tuning plate and changing the resonance frequency in accordance with the equation $$\rho_1 c_1 \cot\left(2\pi f \frac{s}{c_1}\right).$$

17 Claims, 1 Drawing Sheet

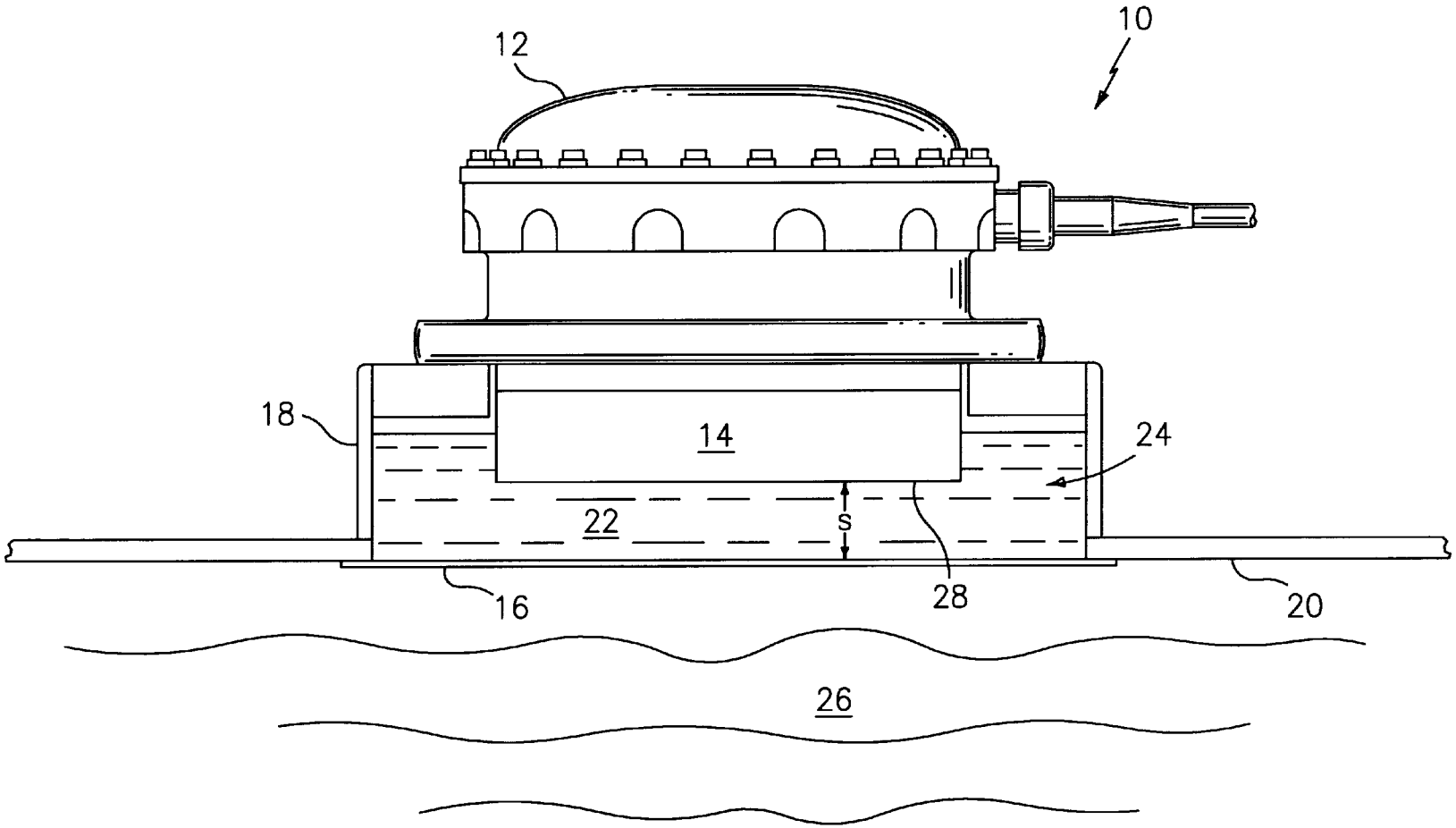
10
12
14
16
18
20
22
24
26
28
S

SONAR TRANSDUCER WITH TUNING PLATE AND TUNING FLUID

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

The present invention is directed to a sonar transducer with a tuning plate and a tuning fluid having increased maximum power which may be radiated from a given transducer by increasing the radiation resistance seen by the transducer. The present invention also is directed to providing a method for setting the mechanical resonant frequency of a sonar transducer above or below the value which is characteristic of the transducer without the tuning system.

(2) Description of the Prior Art

In general, the power which may be radiated in a fluid medium by a transducer is proportional to the product of the area of the radiating surface, the square of the surface velocity, and the characteristic impedance (sound speed times fluid density) of the medium. Thus to increase the radiated power, either the surface area, or the velocity, or both, must be increased. However, the radiating surface area of a sonar transducer is usually limited by the requirement to produce a specific directional characteristic (beam pattern). In addition, the maximum velocity which may be achieved is limited by physical constraints on the transduction material, such as maximum electrical field or maximum mechanical strain.

In a sonar transducer in which body stress in the active transduction material (such as, for example, electrostrictive or magnetostrictive materials) is used to convert electrical energy into mechanical energy, the optimum design with respect to power output and bandwidth is achieved when the characteristic mechanical impedance (density times sound speed times cross sectional area) of the transduction material is matched to (i.e. equals) that of the acoustical load. Since the characteristic impedance (density times sound speed) of the transduction material and the fluid medium are inherent material properties, an attempt to achieve the desired match of the characteristic mechanical impedances may take the form of a mechanical area transformation. In the design of a longitudinal vibrator or tonpilz such an impedance match is often approximated by employing a piston whose area is much greater than the area of the active transduction material. In particular, the characteristic impedance of typical piezoelectric ceramic materials (such as lead zirconate titanate) is in the order of 34,000,000 MKS Rayls, whereas the characteristic impedance of sea water is about 1,500,000 MKS Rayls. This would indicate an area ratio of about 23 to 1 to achieve the optimum match of the characteristic mechanical impedance. The dimensions of the radiating piston are generally dictated by directivity considerations, leaving only the area of the ceramic as a design variable. However, use of an area ratio of 23 to 1 would result in a very fragile ceramic configuration. Other considerations, such as withstanding hydrostatic pressure and explosive shock, dictate that the maximum practical area ratio is in the order of 6 to 1. This results in about a 4 to 1 mismatch between the sonar transducer and the fluid medium. For these reasons, it has never been possible to achieve a perfect match.

SUMMARY OF THE INVENTION

Accordingly, it is an object of the present invention to provide a method for designing a transducer so that the radiation resistance seen by the transducer is increased to facilitate higher power output.

It is a further object of the present invention to provide a method for designing a sonar transducer having a mechanical resonant frequency which may be decreased or increased.

It is still a further object of the present invention to provide a smaller, lighter sonar transducer.

The foregoing objects are achieved by the method and the sonar transducer of the present invention.

In accordance with the present invention, a method for maximizing the radiated power of a transducer broadly comprises the steps of providing a transducer system comprising a transducer operating at a frequency f and having a face, a tuning fluid medium having a density of $\rho_1$ and a speed of sound $c_1$, a tuning plate having a density $\rho_p$ and a thickness t spaced a distance s from the transducer face, and an external fluid medium having a density $\rho_2$ and a speed of sound $c_2$; and tuning the transducer by choosing $\rho_p$, t, and s so that $$\tan\left(2\pi f \frac{s}{c_1}\right) = \frac{\rho_1 c_1}{2\pi f \rho_p t} \tag{1}$$

Further, in accordance with the present invention, a method for changing the resonance frequency of a transducer is provided. The method comprises the steps of providing a transducer system having a transducer with a face and an operating frequency f, a tuning plate spaced from the transducer face by a distance s, and a fluid medium between the transducer face and the tuning plate having a density $\rho_1$ and a speed of sound $c_1$; and decreasing the resonance frequency if the expression below is positive or increasing the resonance frequency if it is negative.

$$\rho_1 c_1 \cot\left(2\pi f \frac{s}{c_1}\right) \tag{2}$$

The present invention also relates to a transducer system for use on a vehicle traveling through an external fluid medium having a density $\rho_2$ and a speed of sound $c_2$. The transducer system broadly comprises a transducer having a radiating face and an operating frequency f, rigid wall means for positioning the transducer relative to an exterior wall of the vehicle, a tuning plate for separating the transducer from the external medium, which tuning plate has a density $\rho_p$ and a thickness t and being spaced from the radiating face by a distance s, and a tuning fluid positioned intermediate the tuning plate and the radiating face, which tuning fluid has a density $\rho_1$ and a speed of sound $c_1$. The system has a complex specific acoustical impedance at the radiating face in accordance with the equation:

$$Z(s, f) = \left[\frac{(2\pi f \rho_p t)^2}{\rho_2 c_2 \rho_1 c_1} + \frac{\rho_1 c_1}{\rho_2 c_2}\right]\rho_1 c_1 + i\rho_1 c_1 \cot\left(2\pi f \frac{s}{c_1}\right) \tag{3}$$

Other details of the sonar transducer with tuning plate and tuning fluid of the present invention, as well as other objects and advantages attendant thereto, are set forth in the following detailed description and the accompanying drawings wherein like reference numerals depict like elements.

BRIEF DESCRIPTION OF THE DRAWINGS

The FIGURE illustrates a configuration of a sonar transducer system in accordance with the present invention.

DESCRIPTION OF THE PREFERRED EMBODIMENT(S)

Referring now to the FIGURE, a system 10 containing a sonar transducer 12 is illustrated. The sonar transducer 12 is a piston type transducer having a radiating piston 14. The sonar transducer 12 is mounted to a rigid walled sea chest 18 which is incorporated into a hull 20 of a vessel such as an ocean going vessel. An acoustical window 16 separates the interior of the sea chest 18 from an external fluid medium 26. In a nautical setting, the external fluid medium 26 is seawater. The acoustical window 16 comprises a thin tuning plate which may be formed from a metal such as stainless steel, a reinforced plastic such as fiberglass, or an elastomeric material such as polyurethane or rubber. The space 24 bounded by the sonar transducer 12, the walls of the sea chest 18, and the acoustic window 16 is filled with a tuning fluid 22. The tuning fluid 22 may be castor oil, silicone fluid, glycerin, kerosene, or any other suitable medium.

In the system 10, the ratio $R_1$ of the characteristic impedance of the transduction element to the characteristic impedance of the external fluid medium 26 is greater than 1; the ratio $R_2$ of the area of the radiating piston 14 to the area of the transduction element is less than $R_1$; and the system is configured so that the effective specific radiation resistance presented to the transducer piston 14 by the tuning fluid 22, i.e. the real part of Z(s,f) calculated using equation 1 below, is approximately $R_1/R_2$ times the characteristic impedance of fluid 26.

The present invention provides a means and a method for increasing the magnitude of the effective radiation resistance presented to the transducer 12 by the medium, thus increasing the radiated power for a given surface area and velocity.

The important factors in the embodiment of the FIGURE are as follows: (a) the thickness and density of the acoustical window or tuning plate 16; (b) the distance s from the tuning plate 16 to the face 28 of the piston 14; (c) the characteristic impedance (sound speed times density) of the tuning fluid 22; and (d) the characteristic impedance of the external fluid medium 26.

The complex specific acoustical impedance at the radiating face 28 of the sonar transducer 12 for the system 10 shown in the FIGURE may be described by the following equation:

$$Z(s,f)=\left[\frac{\rho_2c_2-i\left(2\pi f\rho_p t+\rho_1c_1\tan\left(2\pi f\frac{s}{c_1}\right)\right)}{\rho_1c_1-2\pi f\rho_p t\tan\left(2\pi f\frac{s}{c_1}\right)-i\rho_2c_2\tan\left(2\pi f\frac{s}{c_1}\right)}\right]\rho_1c_1 \tag{4}$$

where:

- $c_1$ is the sound speed in the tuning fluid 22 in meters per second;
- $\rho_1$ is the density of the tuning fluid 22 in kilograms per cubic meter;
- $c_2$ is the sound speed in the external fluid medium 26 in meters per second;
- $\rho_2$ is the density of the external fluid medium 26 in kilograms per cubic meter;
- $\rho_p$ is the density of the acoustic window or tuning plate material in kilograms per cubic meter;
- t is the thickness of the acoustic window or tuning plate in meters;
- f is the operating frequency, Hertz;
- s is the distance from the transducer radiating piston 14 to the acoustic window or tuning plate 16 in meters; and
- i is the imaginary number equal to the square root of negative one.

Three possible tuning methods are described hereinafter: (a) tuning by means of the tuning plate 16 in combination with the tuning fluid 22; (b) tuning by means of the tuning plate 16 alone; and (c) tuning by means of the tuning fluid 22 alone.

Consider the denominator of equation 4, when the values of the variables are such that $$\tan\left(2\pi f\frac{s}{c_1}\right)=\left(\frac{\rho_1c_1}{2\pi f\rho_p t}\right) \tag{5}$$

the real term in the denominator vanishes. Since the operating frequency f is generally specified, this constraint is achieved by the proper selection of spacing s, tuning plate density $\rho_p$ and thickness t, and the tuning fluid characteristic impedance $\rho_1c_1$.

When the constraint indicated in equation 2 is satisfied, equation 4 reduces to:

$$Z(s,f)=\left[\frac{(2\pi f\rho_p t)^2}{\rho_2c_2\rho_1c_1}+\frac{\rho_1c_1}{\rho_2c_2}\right]\rho_1c_1+i\rho_1c_1\cot\left(2\pi f\frac{s}{c_1}\right) \tag{6}$$

The first term in equation 6 describes the specific acoustic resistance at the face of the transducer 12, and the second (imaginary) term represents the specific acoustic reactance. The resistive component may be optimized to achieve the desired radiated power and the reactive component may be set to increase or decrease the resonance frequency of the transducer 12.

In the event that the tuning fluid 22 and the external fluid medium 26 are identical, which would be the case, for example, if the sea chest is free-flooded, then $\rho_1c_1=\rho_2c_2$ and the complex impedance is given by $$Z(s,f)=\left[\left(\frac{2\pi f\rho_p t}{\rho_2c_2}\right)^2+1\right]\rho_2c_2+i\rho_2c_2\cot\left(2\pi f\frac{s}{c_2}\right) \tag{7}$$

In this example, the radiation resistance may be increased over the characteristic impedance by choosing appropriate values of $\rho_p$ and t. For instance, to make the radiation resistance four times the value of $\rho_2c_2$, one sets $$\left(\frac{2\pi f\rho_p t}{\rho_2c_2}\right)^2+1=4 \tag{8}$$

and find that the solution is $$\rho_p t=\frac{\sqrt{3}\,\rho_2c_2}{2\pi f} \tag{9}$$

Thus any tuning plate 16 whose product of density times thickness equals $$\frac{\sqrt{3}\rho_2 c_2}{2\pi f}$$

will meet the requirement. The spacing from the sonar transducer to the tuning plate for this design is computed from:

$$s = \frac{c_2}{2\pi f}\arctan\left(\frac{\rho_2 c_2}{2\pi f \rho_p t}\right) \tag{10}$$

Tuning may also be achieved by the selection of the proper tuning fluid 22. In this approach, the acoustic window or tuning plate 16 is replaced by a thin membrane of negligible density per unit area (the product of density times thickness). For this approach, either $\rho_p$ or t is set to equal to 0 in equation 4 with the result:

$$Z(s, f) = \left[\frac{\rho_2 c_2 - i\rho_1 c_1 \tan\left(2\pi f \frac{s}{c_1}\right)}{\rho_1 c_1 - i\rho_2 c_2 \tan\left(2\pi f \frac{s}{c_1}\right)}\right]\rho_1 c_1 \tag{11}$$

Now if the spacing s in equation 11 is adjusted so that $s=c_1/4f$, or any odd multiple thereof, the impedance at the transducer will be:

$$Z = \rho_2 c_2\left(\frac{\rho_1 c_1}{\rho_2 c_2}\right)^2 \tag{12}$$

That is, the characteristic impedance of the external fluid medium 26 times the square of the ratio of characteristic impedances of the two fluids 22 and 26. If, for example, the tuning fluid 22 is glycerin and the external fluid medium 26 is sea water, the radiation resistance will be increased by a factor of 2.37, that is, $$Z=(2.37)\rho_2 c_2 \tag{13}$$

The present invention has numerous advantages. For example, the radiation resistance of a fluid medium may be increased over its plane wave value, permitting greater output power for a specified velocity from a sonar transducer. Further, the mechanical resonant frequency of a sonar transducer may be increased or decreased by an appropriate choice of tuning plate material, dimensions, and spacing and coupling fluid 22. A smaller, lighter sonar transducer may be designed to achieve a required level of output power using the principles disclosed herein.

Many alternative configurations to the suggested practical embodiment of the FIGURE may be designed to take advantage of the principles of acoustical tuning. These include, for example, incorporating the acoustical tuning system as an integral part of a sonar transducer design. In this approach, the sonar transducer, enclosure (sea chest), tuning fluid, and tuning plate may be configured as a self-contained, integral unit.

Large sonar arrays comprised of a multiplicity of acoustically tuned transducers may be designed for increased output power and beamforming capability.

The theoretical model of this disclosure is predicated on plane wave propagation generated by a rigid circular piston. However, the principles are easily applied to a cylindrical transducer geometry, in which a radially propagating cylindrical wave is generated. In such a design, the system would be co-axial with the cylindrical axis of the transducer, and the tuning plate would be replaced with a thin walled concentric tuning tube or cylinder. The tuning fluid would occupy the space between the cylindrical transducer and the tuning tube.

The mechanical resonant frequency of the tuned transducer may be set above or below the value of the untuned transducer.

It is apparent that there has been provided in accordance with the present invention a sonar transducer with tuning plate and tuning fluid which fully satisfies the objects, means, and advantages set forth hereinbefore. While the present invention has been described in the context of specific embodiments thereof, other alternatives, modifications, and variations will become apparent to those skilled in the art having read the foregoing description. Accordingly, it is intended to embrace those alternatives, modifications and variations as fall within the broad scope of the appended claims.

What is claimed is:

1. A method for maximizing the radiated power of a transducer comprising the steps of:

providing a transducer system comprising a transducer operating at a frequency f and having a face, a tuning fluid medium having a first medium density $\rho_1$ and a first speed of sound $c_1$, a tuning plate having a plate density $\rho_p$ and a thickness t, and an external fluid medium having a second medium density $\rho_2$ and a second speed of sound $c_2$; and tuning the transducer system to have a maximum specific acoustic resistance at said face in accordance with the equation:

$$\left[\frac{(2\pi f \rho_p t)^2}{\rho_2 c_2 \rho_1 c_1} + \frac{\rho_1 c_1}{\rho_2 c_2}\right]\rho_1 c_1.$$

2. A method according to claim 1, wherein said tuning fluid medium is the same as said external fluid medium and said tuning step is performed using the formula:

$$\left[\left(\frac{2\pi f \rho_p t}{\rho_2 c_2}\right)^2 + 1\right]\rho_2 c_2.$$

3. A method according to claim 2, wherein said tuning step further comprises selecting a value for radiation resistance RR and determining a value for the density of said plate times the thickness of said plate in accordance with the equation:

$$RR = \left(\frac{2\pi f \rho_p t}{\rho_2 c_2}\right)^2 + 1.$$

4. A method according to claim 3, further comprising computing a distance s from the transducer face to said tuning plate in accordance with the equation:

$$s = \frac{c_2}{2\pi f}\arctan\left(\frac{\rho_2 c_2}{2\pi f \rho_p t}\right).$$

5. A method according to claim 1, further comprising changing a resonance frequency of said transducer in accordance with the equation:

$$\rho_1 c_1 \cot\left(2\pi f \frac{s}{c_1}\right)$$

where s is the distance between said transducer face and said tuning plate.

6. A method according to claim 1, further comprising:

setting the value of a selected one of t and $\rho_p$ to 0;

adjusting the spacing s between said transducer face and said tuning plate to be $s=nc_1/4f$ where n is an odd integer; and determining the impedance at the transducer using the equation:

$$Z = \rho_2 c_2 \left(\frac{\rho_1 c_1}{\rho_2 c_2}\right)^2.$$

7. A method for changing the resonance frequency of a transducer comprising the steps of:

providing a transducer system having a transducer with a face and an operating frequency f, a tuning plate spaced from said transducer face by a distance s, and a fluid medium between said transducer face and said tuning plate having a density $\rho_1$ and a speed of sound $c_1$; and changing said resonance frequency by adjusting parameters in accordance with the equation:

$$\rho_1 c_1 \cot\left(2\pi f \frac{s}{c_1}\right).$$

8. A method according to claim 7, wherein said changing step comprises increasing said resonance frequency.

9. A method according to claim 7, wherein said changing step comprises decreasing said resonance frequency.

10. A transducer system for use on a vehicle traveling through an external fluid medium having a density $\rho_2$ and a speed of sound $c_2$ comprising:

a transducer having a radiating face and an operating frequency f;

rigid wall means for positioning said transducer relative to an exterior wall of said vehicle;

a tuning plate for separating said transducer from said external medium, said tuning plate having a density $\rho_p$ and a thickness t and being spaced from said radiating face by a distance s;

a tuning fluid positioned intermediate said tuning plate and said radiating face of said transducer, said tuning fluid having a density $\rho_1$ and a speed of sound $c_1$; and said system having a complex specific acoustical impedance at said radiating face in accordance with the equation:

$$Z(s, f) = \left[\frac{(2\pi f \rho_p t)^2}{\rho_2 c_2 \rho_1 c_1} + \frac{\rho_1 c_1}{\rho_2 c_2}\right]\rho_1 c_1 + i\rho_1 c_1 \cot\left(2\pi f \frac{s}{c_1}\right).$$

11. A system according to claim 10, wherein said tuning fluid is identical to said external medium and said complex specific acoustical impedance is in accordance with the equation:

$$Z(s, f) = \left[\left(\frac{2\pi f \rho_p t}{\rho_2 c_2}\right)^2 + 1\right]\rho_2 c_2 + i\rho_2 c_2 \cot\left(2\pi f \frac{s}{c_2}\right).$$

12. A system according to claim 11, wherein said spacing is in accordance with the equation:

$$s = \frac{c_2}{2\pi f} \arctan\left(\frac{\rho_2 c_2}{2\pi f \rho_p t}\right).$$

13. A system according to claim 10, wherein said complex specific acoustical impedance at said radiating face is in accordance with the equation:

$$Z(s, f) = \left[\frac{\rho_2 c_2 - i\rho_1 c_1 \tan\left(2\pi f \frac{s}{c_1}\right)}{\rho_1 c_1 - i\rho_2 c_2 \tan\left(2\pi f \frac{s}{c_1}\right)}\right]\rho_1 c_1$$

where i is the square root of −1.

14. A system according to claim 13, wherein said spacing s equals $nc_1/4f$ and where n is an odd integer and said specific acoustical complex impedance is in accordance with the equation:

$$Z = \rho_2 c_2 \left(\frac{\rho_1 c_1}{\rho_2 c_2}\right)^2.$$

15. A system according to claim 10, wherein said vehicle comprises a nautical vessel, said external medium comprises seawater, and said transducer comprises a sonar transducer.

16. A system according to claim 15, wherein said sonar transducer has a piston.

17. A system according to claim 15, wherein said external wall comprises a hull of said vessel and said rigid walled means comprises a sea chest.

* * * * *